US009951939B1

(12) United States Patent
Lan

(10) Patent No.: US 9,951,939 B1
(45) Date of Patent: Apr. 24, 2018

(54) LED LIGHT

(71) Applicant: Shenzhen Guanke Technologies Co., Ltd., Shenzhen (CN)

(72) Inventor: Qing Lan, Shenzhen (CN)

(73) Assignee: Shenzhen Guanke Technologies Co., Ltd., Shenzhen (CN)

( * ) Notice: Subject to any disclaimer, the term of this patent is extended or adjusted under 35 U.S.C. 154(b) by 0 days.

(21) Appl. No.: 15/619,499

(22) Filed: Jun. 11, 2017

(30) Foreign Application Priority Data

May 5, 2017 (CN) ..... 2017 2 0504380 U

(51) Int. Cl.

| | |
|---|---|
| ***F21V 29/77*** | (2015.01) |
| ***F21V 23/06*** | (2006.01) |
| ***F21V 19/00*** | (2006.01) |
| ***F21V 23/02*** | (2006.01) |
| *F21Y 115/10* | (2016.01) |

(52) U.S. Cl.
CPC ..... *F21V 29/77* (2015.01); *F21V 19/003* (2013.01); *F21V 23/02* (2013.01); *F21V 23/06* (2013.01); *F21Y 2115/10* (2016.08)

(58) Field of Classification Search
CPC ..... F21V 29/77; F21V 19/003; F21V 23/02; F21V 23/06
USPC ..... 362/373, 285, 287, 184, 218, 220, 225, 362/249.02, 249.03, 249.07, 249.09, 362/249.1
See application file for complete search history.

(56) References Cited

U.S. PATENT DOCUMENTS

| | | | | |
|---|---|---|---|---|
| 8,072,123 | B1 * | 12/2011 | Han | F21K 9/23 313/45 |
| 9,170,006 | B2 * | 10/2015 | Cugini | F21V 21/145 |
| 2005/0099810 | A1 * | 5/2005 | Tasson | B60Q 1/2607 362/249.07 |
| 2009/0116210 | A1 * | 5/2009 | Cutler | G03B 15/02 362/8 |
| 2009/0168422 | A1 * | 7/2009 | Chiu | F21S 2/005 362/249.03 |
| 2012/0057333 | A1 * | 3/2012 | Bhardwaj | F21L 13/06 362/183 |
| 2013/0194805 | A1 * | 8/2013 | Lin | F21V 17/104 362/249.03 |
| 2013/0271993 | A1 * | 10/2013 | Jan | F21V 21/30 362/249.09 |
| 2014/0049956 | A1 * | 2/2014 | Manahan | F21V 21/14 362/233 |
| 2014/0240990 | A1 * | 8/2014 | Bae | F21V 29/22 362/294 |

(Continued)

*Primary Examiner* — Laura Tso

(57) ABSTRACT

An LED light includes a holder, a power supply electrically connected to the holder, a body electrically to the power supply, a connecting plate connects the power supply with the body, and a heat sink connected with the connecting plate. The heat sink includes a first cooling fin, a second cooling fin and a third cooling fin. The second cooling fin connects between the first and the third cooling fins. The first and the third cooling fins each include a rotational axis, and the connecting plate includes a pair of grooves to engage with a corresponding rotational axis. The first and the third cooling fins rotate relative to the second cooling fin via rotating the rotational axis, an angle within 180-360 degree is formed between the first and the third cooling fins and the second cooling fin. The configuration of heat sink may improve the heat radiation effects.

12 Claims, 6 Drawing Sheets

(56) References Cited

U.S. PATENT DOCUMENTS

| | | | | |
|---|---|---|---|---|
| 2014/0293603 | A1* | 10/2014 | Barnard | F21V 29/74 362/241 |
| 2015/0338083 | A1* | 11/2015 | Gallego Sanz | F21V 29/70 362/373 |
| 2015/0354794 | A1* | 12/2015 | Guercio | F21V 21/30 362/235 |

* cited by examiner

LED LIGHT

BACKGROUND

1. Technical Field

The present disclosure generally relates to light sources field, and especially relates to an LED light.

2. Description of Related Art

LED lights are used in various fields such as display devices, decorations, backlights and illuminations which are characterized by non-pollution, energy-saving, long lifespan and small in size. In general, the maximum light angle of a typical LED is 120 degree. In order to obtain uniform light and adjustable light angles, the light angle of the ordinary LED light is designed for two types: one type is 180 degree, the other type is 360 degree. Such type of the light angle is too single to heat radiation, thereby it is needed to design vents for obtaining reliably heat radiation.

SUMMARY

The disclosure relates to an LED light which may optionally adjust the light angle between 180 degree and 360 degree and improve heat radiation effects.

In one aspect, an LED light includes: a holder, a power supply, a plurality of bodies, a connecting plate and a heat sink, the power supply electrically connects to the holder, the plurality of bodies electrically connects to the power supply, the connecting plate connects the power supply with the plurality of bodies and includes a pair of grooves, the heat sink connects with the connecting plate and includes a first cooling fin, a second cooling fin and a third cooling fin; the second cooling fin connects the first cooling fin with the third cooling fin; each of the first cooling fin and the third cooling fin includes a rotational axis to movably engage with a corresponding groove of the connecting plate, wherein an angle between 180 degree and 360 degree is formed between each of the first cooling fin and the third cooling fin and the second cooling fin, when each of the first cooling fin and the third cooling fin rotates relative to the second cooling fin via rotating their respective rotational axis, the first cooling fin is adjacent to the third cooling fin when the angle is 360 degree, while the first cooling fin is positioned far away from the third cooling fin when the angle is 180 degree.

Wherein a gap is formed between every two adjacent cooling fins of the first cooling fin and the second cooling fin and the third cooling fin, each of the first cooling fin, the second cooling fin and the third cooling fin includes a first recess for receiving the plurality of bodies therein.

Wherein the plurality of bodies cooperatively form a circle so as to obtain a light angle of 360 degree when the angle is 360 degree, while the plurality of bodies form a half circle so as to obtain a light angle of 180 degree when the angle is 180 degree.

Wherein the connecting plate includes a first connecting plate, a second connecting plate and a third connecting plate, the second connecting plate positions between the first connecting plate and the third connecting plate, the first connecting plate, the second connecting plate and the third connecting plate connects with each other, end to end, wherein each of the pair of grooves is formed on the first connecting plate and the third connecting plate, the first connecting plate and the third connecting plate are on the same plane, the second connecting plate is non-planar with the first connecting plate and the third connecting plate.

Wherein the LED light further includes a baseboard tightly connected with the bottom of the heat sink, the baseboard includes a first bottom plate tightly connected with the first cooling fin, a second bottom plate tightly connected with the second cooling fin, and a third bottom plate tightly connected with the third cooling fin.

Wherein the LED light further includes a fixing plate tightly connected with the second bottom plate, both the first bottom plate and the third bottom plate movably connect with the fixing plate.

Wherein the first bottom plate includes a first protrusion protruding upward from the topside near an end of the second bottom plate, the second bottom plate includes a first stop and a second stop positioned on two opposite ends thereof, the third bottom plate includes a second protrusion protruding upward from the topside near the opposite end of the second bottom plate, the first stop limits a movable position of the first protrusion and the second stop limits a movable position of the second protrusion when the first bottom plate and the third bottom plate respectively move relative to the fixing plate.

Wherein the first stop abuts against the first protrusion and the second stop abuts against the second protrusion when the angle between the first, the third cooling fins and the second cooling fin is 360 degree, the first stop is out of touch with the first protrusion, and the second stop is out of touch with the second protrusion when the angle between the first cooling fin and the third cooling fin and the second cooling fin is 180 degree.

Wherein the fixing plate includes a plurality of through-holes extending from the top to the bottom therethrough, among the first bottom plate, the second bottom plate and the third bottom plate form an aperture, the aperture is positioned on the corresponding through-holes for heat radiation.

Wherein the LED light further includes a wiring plate connecting the connecting plate with the heat sink, the connecting plate includes a second recess for receiving the wiring plate therein, one end of the wiring plate connects with the power supply and the opposite end of the wiring plate connects with the plurality of bodies.

Wherein the LED light further includes a case, the case includes a receiving space in the middle thereof for receiving the power supply therein.

Wherein the LED light further includes a connecting member tightly connected the holder with the case.

The present disclosure provides the advantages as below.

First, the pair of grooves of the connecting plate engages with the corresponding rotational axis of the heat sink, the first cooling fin, the second cooling fin and the third cooling fin of the heat sink receive the plurality of bodies therein, thus the rotation angle, which between 180 degree and 360 degree, of the first cooling fin and the third cooling fin relative to the second cooling fin is achieved. With such configuration, the LED light may optionally adjust the light angle between 180 degree and 360 degree.

Second, the configuration of the heat sink is designed without vents, the heat radiation may be carried out by air convection during the heat sink in an unfolded state. In this way, the heat radiation effects of the LED light may be improved.

DETAILED DESCRIPTION

Figure 1:
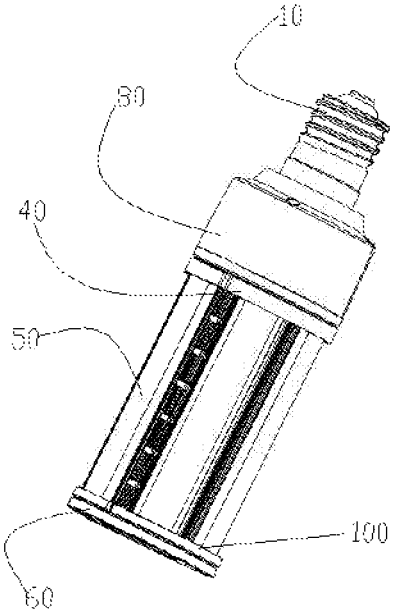
FIG. 1 is a schematic view of the LED light in accordance with an embodiment.

The disclosure is illustrated by way of example and not by way of limitation in the figures of the accompanying drawings, in which like reference numerals indicate similar elements.

Figure 2:
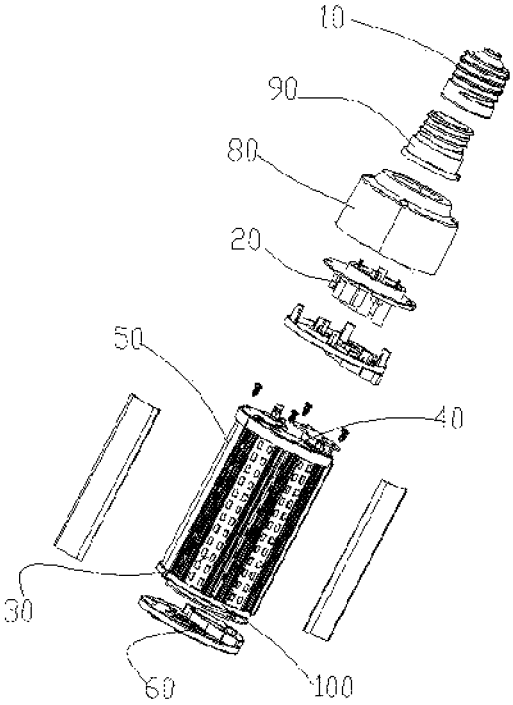
FIG. 2 is an exploded view of the LED light of FIG. 1.
Figure 6:
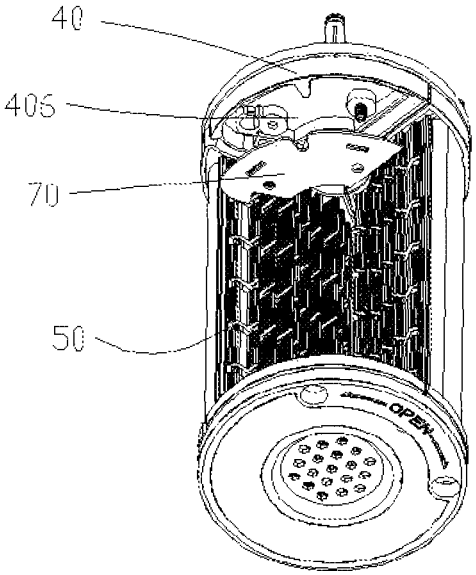
FIG. 6 is a partial schematic view of the LED light of FIG. 1, focused on showing the connecting plate, the heat sink and a wiring plate thereof.
Figure 7:
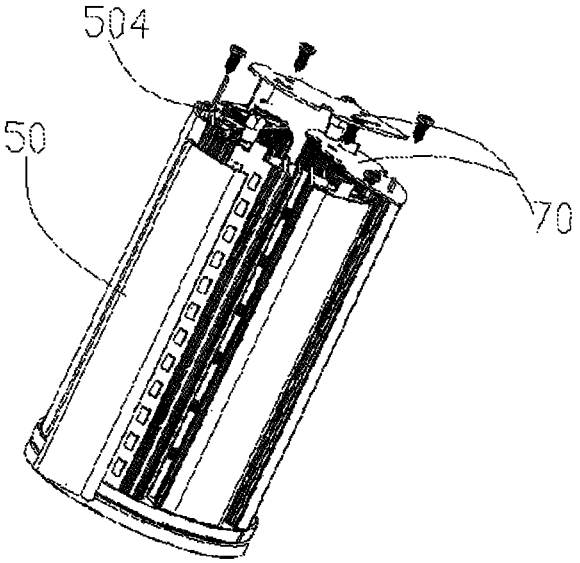
FIG. 7 is a partial schematic view of the LED light of FIG. 1, focused on showing the heat sink and the wiring plate thereof.
Figure 8:
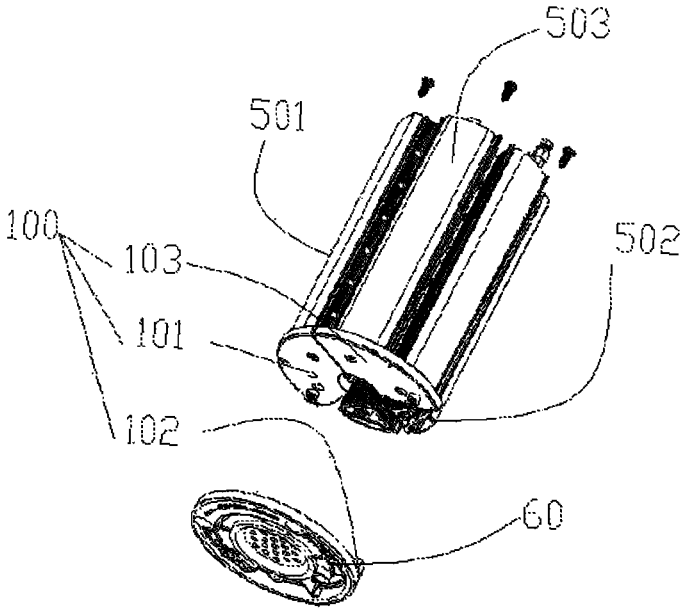
FIG. 8 is a partial exploded view of the LED light of FIG. 1, focused on showing a baseboard, a fixing plate and the heat sink from the bottom view.
Figure 9:
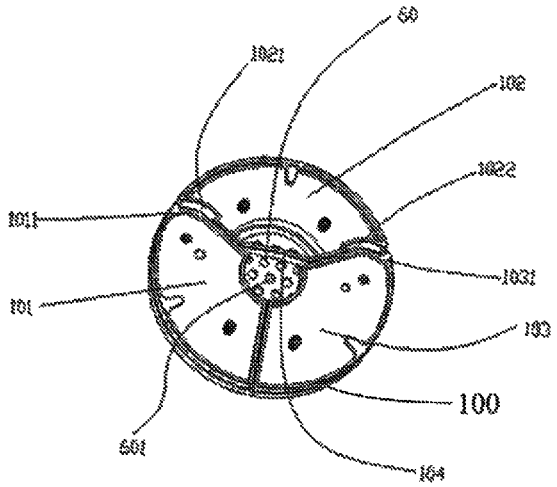
FIG. 9 is a schematic view showing the assembly of the baseboard and the fixing plate of the LED light of FIG. 1.

Referring to FIGS. 1-2, the LED light includes a holder 10, a power supply 20, a plurality of bodies 30, a connecting plate 40, a heat sink 50, a fixing plate 60, a wiring board 70 (shown in FIG. 6), a case 80, a connecting member 90 and a baseboard 100. The power supply 20 electrically connects to the holder 10. The plurality of bodies 30 electrically connects to the power supply 20. The connecting plate 40 connects the power supply 20 with the plurality of bodies 30. The heat sink 50 tightly connects with the connecting plate 40. The fixing plate 60 tightly connects with the baseboard 100. The wiring board 70 connects the connecting plate 40 with the heat sink 50. The case 80 includes a receiving space in the middle portion thereof for receiving the power supply 20 therein. On the one hand, the case 80 may prevent the power supply 20 from being exposed outside so as to avoid leakage. On the other hand, the power supply 20 may improve lifespan without air pollution.

The connecting member 90 includes threads arranged in two opposite ends thereof for tightly connecting the holder 10 with the case 80 in order to more convenient and rapid to assembly the holder 10 and the case 80. One end of the baseboard 100 tightly connects with the heat sink 50, the opposite end of the baseboard 100 tightly connects with the fixing plate 60.

Figure 3:
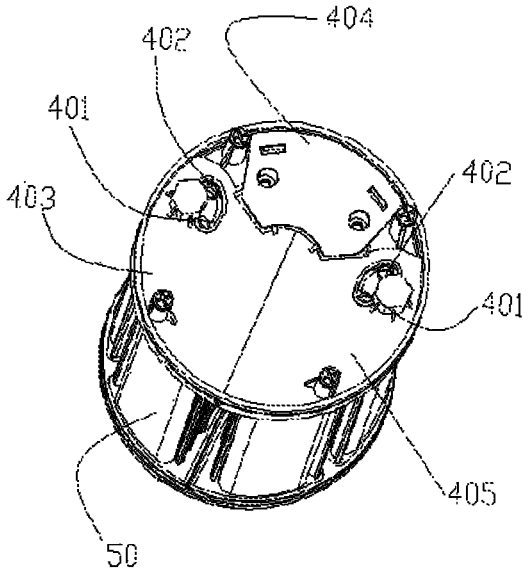
FIG. 3 is a schematic view of a connecting plate and a heat sink of the LED light of FIG. 1.
Figure 4:
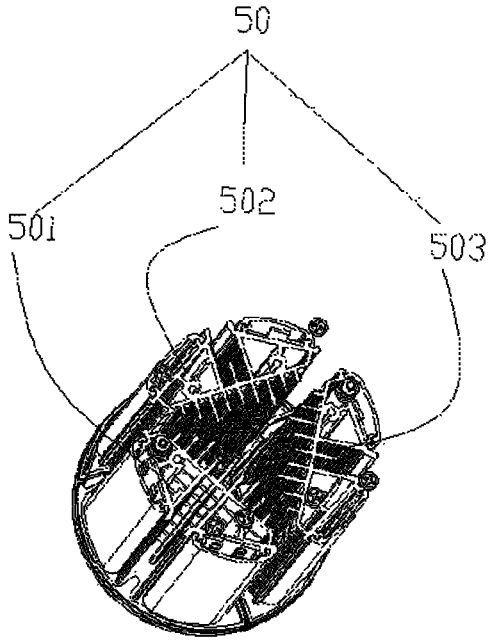
FIG. 4 is a schematic view of the heat sink of the LED light of FIG. 1.
Figure 5:
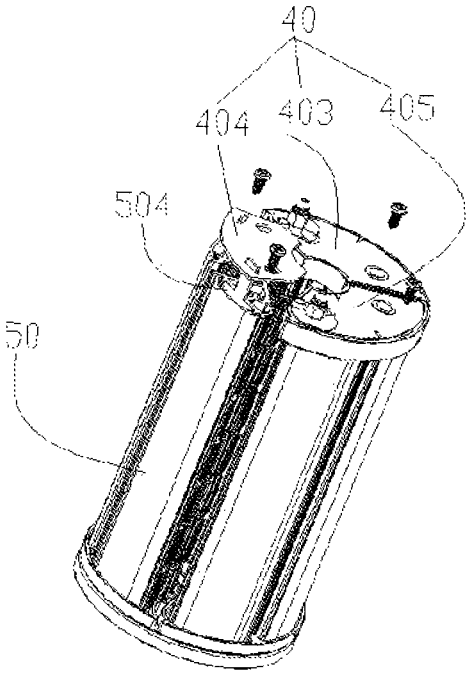
FIG. 5 is a partial schematic view of the LED light of FIG. 1, focused on showing the connecting plate and the heat sink thereof.

Referring to FIGS. 3-5, the connecting plate 40 includes a first connecting plate 403, a second connecting plate 404 and a third connecting plate 405. The second connecting plate 404 positions between the first connecting plate 403 and the third connecting plate 405. The first connecting plate 403, the second connecting plate 404 and the third connecting plate 405 connects with each other, end to end. The first connecting plate 403 and the third connecting plate 405 respectively includes a groove 401 arranged in a side thereof. The groove 401 is circular-arc-shaped and the central angle of the groove 401 is 90 degree. The first connecting plate 403 and the third connecting plate 405 are on the same plane. The second connecting plate 404 is non-planar with the first connecting plate 403 and the third connecting plate 405, but higher than the first connecting plate 403 and the third connecting plate 405. In this way, a first gap (not labeled) is formed between the first connecting plate 403 and the second connecting plate 404, and a second gap (not labeled) is formed between the second connecting plate 404 and the third connecting plate 405. When the first connecting plate 403 and the third connecting plate 405 are turned, the internal stress produced by the first connecting plate 403 and the third connecting plate 405 may not transmit to the second connecting plate 404, thus the lifespan of the connecting plate 40 is improved. Furthermore, the heat produced by the holder 10 and the power supply 20 transmits from the first gap and the second gap to the beat sink 50 and then sends out from the heat sink 50. That is, the reasonable configuration of the LED light may own favorable heat radiation effects.

Referring to FIGS. 6-9, the first connecting plate 403, the second connecting plate 404 and the third connecting plate 405 cooperatively form a second recess 406 on the bottom thereof. The second recess 406 receives the wiring board 70 therein. In this way, the wiring board 70 is completely received in the connecting plate 40, which avoids the wiring board 70 expose outside and contributes to insecure use of the LED light. One end of the wiring board 70 electrically connects to the power supply 20, and the opposite end electrically connects to the plurality of bodies 30.

The heat sink 50 includes a first cooling fin 501, a second cooling fin 502 and a third cooling fin 503. The second cooling fin 502 connects between the first cooling fin 501 and the third cooling fin 503. Each of the first cooling fin 501 and the third cooling fin 503 includes a rotational axis 402 at a side thereof. The second cooling fin 502 tightly connects with the connecting plate 40 without a rotational axis configuration. The rotational axis 402 rotationally engages with a corresponding groove 401. That is, the rotation angle of the rotational axis 402 depends on the central angle of the groove 401. The first cooling fin 501 and the third cooling fin 503 turn relative to the second cooling fin 502 when their respective rotational axis 402 rotate in a corresponding groove 401, an angle between 180 degree and 360 degree thereby forms between the first cooling fin 501, the third cooling fin 503 and the second cooling fin 502. The first cooling fin 501 is adjacent to the third cooling fin 503 when the angle is 360 degree. Otherwise, the first cooling fin 501 is positioned far away from the third cooling fin 503 when the angle is 180 degree. In addition, it may select a suitable angle between 180 degree and 360 degree via manually turning the first cooling fin 501 and the third cooling fin 503 according to the actual needs, which the operations are convenient and simple.

A third gap (not labeled) is formed between every two adjacent cooling fins 501, 502, 503. Each of the first cooling fin 501, the second cooling fin 502 and the third cooling fin 503 includes a pair of first recesses 504 on a side thereof. The pair of first recesses 504 receives the corresponding bodies 30 therein. In this way, the heat sink 50 may unfold and fold without designing a vent. The heat from the heat sink 50 is sent out by air convection during the heat sink 50 in an unfolded state. That is, the internal hollowing structure of the first cooling fin 501, the second cooling fin 502 and the third cooling fin 503 is configured to increase the convection area of the heat sink 50 so as to improve the heat radiation effects.

In the embodiment of the disclosure, the first connecting plate 403 corresponds to the first cooling fin 501, the second connecting plate 404 corresponds to the second cooling fin 502, and the third connecting plate 405 corresponds to the third cooling fin 503. That is, the first connecting plate 403 and the third connecting plate 405 may turn relative to the second connecting plate 404 according to the rotation of the first cooling fin 501 and the third cooling fin 503 relative to the second cooling fin 502.

The first cooling fin 501 and the third cooling fin 503 turn so as to form an angle therebetween. The plurality of bodies 30, together with the first cooling fin 501, the second cooling fin 502 and the third cooling fin 503, cooperatively form a corresponding light angle discretionarily selected from the angle between 180 degree and 360 degree.

The baseboard 10 tightly connects with the bottom of the heat sink 50. The baseboard 100 includes a first bottom plate 101, a second bottom plate 102 and a third bottom plate 103. The top of the second bottom plate 102 tightly connects with the bottom of the second cooling fin 502, and the bottom of the second bottom plate 102 tightly connects with the fixing plate 60. The top of the first bottom plate 101 tightly connects with the bottom of the first cooling fin 501, and the bottom of the first bottom plate 101 movably connects with the fixing plate 60. At the same time, the top of the third bottom plate 103 tightly connects with the bottom of the third cooling fin 503, and the bottom of the third bottom plate 103 movably connects with the fixing plate 60.

The first bottom plate 101 corresponds to the first cooling fin 501, the second bottom plate 102 corresponds to the second cooling fin 502, and the third bottom plate 103 corresponds to the third cooling fin 503. Both the first bottom plate 101 and the third bottom plate 103 may rotate relative to the fixing plate 60. That is to say, the first cooling fin 501 and the third cooling fin 503 may smoothly rotate relative to the second cooling fin 502, and the first bottom plate 101 and the third bottom plate 103 rotate following the first cooling fin 501 and the third cooling fin 503.

Furthermore, the first bottom plate 101 includes a first protrusion 1011 protruding upward from a side near an end of the second bottom plate 102, while the third bottom plate 103 includes a second protrusion 1031 protruding upward from a side near the opposite end of the second bottom plate 102. At the same time, the second bottom plate 102 includes a first stop 1021 and a second stop 1022 positioned on two opposite ends thereof. The first stop 1021 corresponds to the first protrusion 1011, and the second stop 1022 corresponds to the second stop 1031. The first stop 1021 limits a movable position of the first protrusion 1011 and the second stop 1022 limits a movable position of the second protrusion 1031 when the first and the third bottom plates 101, 103 respectively move relative to the fixing plate 60.

The fixing plate 60 includes a plurality of through-holes 601 extending from the top to the bottom therethrough. Among the first bottom plate 101, the second bottom plate 102 and the third bottom plate 103 form an aperture 104. The aperture 104 corresponds to the through-holes 601, which cooperatively contributes to the heat radiation of the plurality of bodies 30 during the heat sink 50 in the folded state.

Figure 10A:
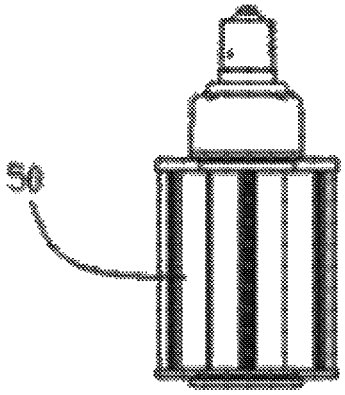
FIG. 10*a* is a front view of the heat sink of the LED light of FIG. 1, shown the heat sink in an unfolded state.
Figure 10B:
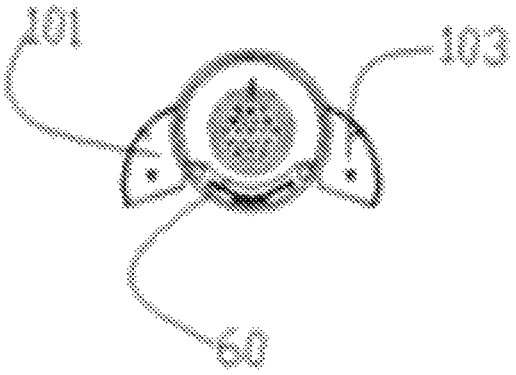
FIG. 10*b* is a top view of the heat sink of the LED light of FIG. 1, shown the heat sink in the unfolded state.

Referring to FIGS. 10*a*-10*b*, when the first cooling fin 501 and the third cooling fin 503 turn relative to the second cooling fin 502 until the heat sink 50 reaches its unfolded state, the angle between the first cooling fin 501 and the third cooling fin 503 is 180 degree. At the same time, the rotational axis 402 turns to reach its maximum movable position, both the first bottom plate 101 and the third bottom plate 103 turn relative to the fixing plate 60 and reach their respective maximum movable position. The first stop 1021 abuts against the first protrusion 1011, and the second stop 1022 abuts against the second protrusion 1031. In this way, the first bottom plate 101 and the third bottom plate 103 may avoid over-rotation. At this time, the light angle of the LED light is 180 degree, and the distance between the first cooling fin 501 and the third cooling fin 503 is maximum, thereby the LED light unfold farthest.

Figure 11A:
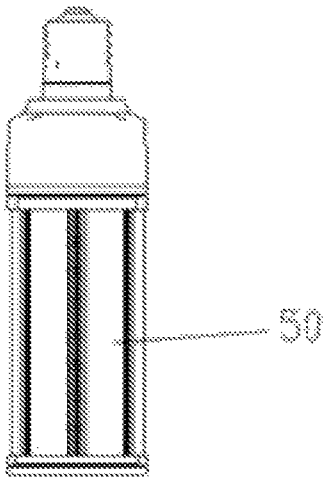
FIG. 11*a* is similar to FIG. 10*a*, but shown the heat sink in a folded state.
Figure 11B:
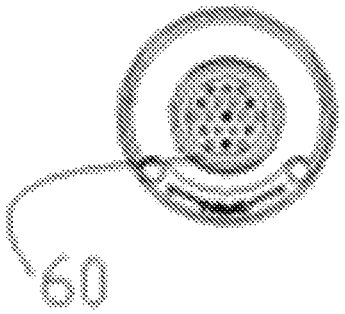
FIG. 11*b* is similar to FIG. 10*b*, but shown the heat sink in the folded state.

Referring to FIGS. 11*a*-11*b*, when the first cooling fin 501 and the third cooling fin 503 turn relative to the second cooling fin 502 until the angle between the first cooling fin 501 and the third cooling fin 503 and the second cooling fin 502 is greater than 180 degree and rarely more than 360 degree. At this time, the first stop 1021 is out of touch with the first protrusion 1011, and the second stop 1022 is also out of touch with the second protrusion 1031. That is, during rotation of the rotational axis 402, the first stop 1021 and the second stop 1022 cooperatively provide enough space for turning the first bottom plate 101 and the third bottom plate 103 therein, which may reduce wear and increase lifespan of the LED light. In addition, when the LED light reaches its unfolded state, the first stop 1021 and the second stop 1022 respectively abut against the corresponding first and second protrusions 1011, 1031 to prevent from over-rotation. At the same time, the second bottom plate 102 supports the first bottom plate 101 and the third bottom plate 103. In this way, the connection between the first bottom plate 101, the third bottom plate 103 and the second bottom plate 102 is stable.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

What is claimed is:

1. An LED light comprising:

a holder;

a power supply electrically connected to the holder;

a plurality of bodies electrically to the power supply;

a connecting plate connected the power supply with the plurality of bodies and comprising a pair of grooves;

a heat sink connected with the connecting plate and comprising a first cooling fin, a second cooling fin and a third cooling fin; the second cooling fin connected the first cooling fin with the third cooling fin; each of the first cooling fin and the third cooling fin comprising a rotational axis to rotationally engage with a corresponding groove of the connecting plate;

wherein an angle between 180 degree and 360 degree is formed between each of the first cooling fin and the third cooling fin and the second cooling fin, when each of the first cooling fin and the third cooling fin rotates relative to the second cooling fin via rotating their respective rotational axis in the corresponding groove; wherein the first cooling fin is adjacent to the third cooling fin when the angle is 360 degree, wherein the first cooling fin is positioned far away from the third cooling fin when the angle is 180 degree.

2. The LED light as claimed in claim 1, wherein a gap is formed between every two adjacent cooling fins of the first cooling fin and the second cooling fin and the third cooling fin, each of the first cooling fin and the second cooling fin and the third cooling fin comprises a first recess for receiving the plurality of bodies therein.

3. The LED light as claimed in claim 2, wherein the plurality of bodies cooperatively form a circle so as to obtain a light angle of 360 degree when the angle is 360 degree, while the plurality of bodies form a half circle so as to obtain a light angle of 180 degree when the angle is 180 degree.

4. The LED light as claimed in claim 1, wherein the connecting plate comprises a first connecting plate, a second connecting plate and a third connecting plate, the second connecting plate positions between the first connecting plate and the third connecting plate, the first connecting plate, the second connecting plate and the third connecting plate connects with each other, end to end, each of the pair of grooves is formed on the first connecting plate and the third connecting plate, the first connecting plate and the third connecting plate are on the same plane, the second connecting plate is non-planar with the first connecting plate and the third connecting plate.

5. The LED light as claimed in claim 1, wherein the LED light further comprises a baseboard tightly connected with the bottom of the heat sink, the baseboard comprises a first bottom plate tightly connected with the first cooling fin, a second bottom plate tightly connected with the second cooling fin, and a third bottom plate tightly connected with the third cooling fin.

6. The LED light as claimed in claim 5, wherein the LED light further comprises a fixing plate tightly connected with the second bottom plate, both the first bottom plate and the third bottom plate movably connect with the fixing plate.

7. The LED light as claimed in claim 6, wherein the first bottom plate comprises a first protrusion protruding upward from a topside near an end of the second bottom plate, the third bottom plate comprises a second protrusion protruding upward from a topside near the opposite end of the second bottom plate, the second bottom plate comprises a first stop and a second stop positioned on two opposite ends thereof, the first stop limits a movable position of the first protrusion and the second stop limits a movable position of the second protrusion when the first bottom plate and the third bottom plate respectively move relative to the fixing plate.

8. The LED light as claimed in claim 7, wherein the first stop abuts against the first protrusion and the second stop abuts against the second protrusion when the angle between the first cooling fin, the third cooling fin and the second cooling fin is 360 degree, the first stop is out of touch with the first protrusion and the second stop is out of touch with the second protrusion when the angle between the first cooling fin, the third cooling fin and the second cooling fin is 180 degree.

9. The LED light as claimed in claim 5, wherein the fixing plate comprises a plurality of through-holes extending from the top to the bottom therethrough, among the first bottom plate and the second bottom plate and the third bottom plate form an aperture, the aperture corresponds to the through-holes for heat radiation.

10. The LED light as claimed in claim 1, wherein the LED light further comprises a wiring plate connected the connecting plate with the heat sink, the connecting plate comprises a second recess for receiving the wiring plate therein, one end of the wiring plate connects with the power supply and the opposite end of the wiring plate connects with the plurality of bodies.

11. The LED light as claimed in claim 1, wherein the LED light further comprises a case, the case comprises a receiving space in the middle thereof for receiving the power supply therein.

12. The LED light as claimed in claim 11, wherein the LED light further comprises a connecting member tightly connected the holder with the case.

* * * * *